US010362869B2

(12) United States Patent
Gasser et al.

(10) Patent No.: US 10,362,869 B2
(45) Date of Patent: Jul. 30, 2019

(54) DRAWER ARRANGEMENT

(71) Applicant: Julius Blum GmbH, Hoechst (AT)

(72) Inventors: Ingo Gasser, Hoechst (AT); Herbert Isele, Lustenau (AT); Marc Meusburger, Egg (AT); Emanuel Netzer, Hoechst (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 15/994,373

(22) Filed: May 31, 2018

(65) Prior Publication Data

US 2018/0271274 A1 Sep. 27, 2018

Related U.S. Application Data

(63) Continuation of application No. PCT/AT2016/060090, filed on Oct. 27, 2016.

(30) Foreign Application Priority Data

Dec. 22, 2015 (AT) ..... A 805/2015

(51) Int. Cl.
*A47B 88/40* (2017.01)
*A47B 88/90* (2017.01)
(Continued)

(52) U.S. Cl.
CPC ..... *A47B 88/402* (2017.01); *A47B 88/41* (2017.01); *A47B 88/473* (2017.01);
(Continued)

(58) Field of Classification Search
CPC ... A47B 88/402; A47B 88/941; A47B 88/487; A47B 88/493; A47B 88/944; A47B 2210/0008; A47B 2210/091
See application file for complete search history.

(56) References Cited

U.S. PATENT DOCUMENTS 5,344,227 A * 9/1994 Rock ..... A47B 88/467 312/334.33
5,492,400 A * 2/1996 Rock ..... A47B 88/493 312/331
(Continued)

FOREIGN PATENT DOCUMENTS

CN 203633774 6/2014
DE 24 43 595 4/1976
(Continued)

OTHER PUBLICATIONS

International Search Report dated Feb. 23, 2017 in International (PCT) Application No. PCT/AT2016/060090.
(Continued)

*Primary Examiner* — Daniel J Rohrhoff
(74) *Attorney, Agent, or Firm* — Wenderoth, Lind & Ponack, L.L.P.

(57) ABSTRACT

A drawer arrangement includes a drawer side wall to be connected to a drawer rail of a drawer pull-out guide, the drawer side wall having a support portion for supporting a drawer bottom, and a drawer pull-out guide having a carcass rail to be fixed to a furniture carcass, a drawer rail to be connected to the drawer side wall, and a central rail displaceable between the carcass rail and the drawer rail. The central rail has a side limb and a transverse limb connected therewith. In the mounted position, the side limb of the central rail, at least over a region, is arranged laterally besides the support portion for the drawer bottom. The transverse limb of the central rail and the carcass rail in the mounted position protrude at least partially below the support portion for the drawer bottom.

17 Claims, 6 Drawing Sheets

(51) Int. Cl.

| | |
|---|---|
| ***A47B 88/493*** | (2017.01) |
| ***A47B 88/473*** | (2017.01) |
| ***A47B 88/487*** | (2017.01) |
| ***A47B 88/41*** | (2017.01) |
| ***A47B 88/43*** | (2017.01) |

(52) U.S. Cl.
CPC ..... *A47B 88/487* (2017.01); *A47B 88/493* (2017.01); *A47B 88/941* (2017.01); *A47B 88/43* (2017.01); *A47B 2210/0008* (2013.01); *A47B 2210/0059* (2013.01); *A47B 2210/0091* (2013.01); *A47B 2210/091* (2013.01)

(56) References Cited

U.S. PATENT DOCUMENTS

| | | | | |
|---|---|---|---|---|
| 6,499,818 | B2 | 12/2002 | Brustle | |
| 6,752,478 | B1 * | 6/2004 | Francz ..... | A47B 88/467 312/319.1 |
| 2001/0008037 | A1 | 7/2001 | Brustle | |
| 2001/0008358 | A1 * | 7/2001 | Brustle ..... | A47B 88/467 312/319.1 |
| 2003/0067257 | A1 | 4/2003 | Gasser | |

FOREIGN PATENT DOCUMENTS

| | | |
|---|---|---|
| DE | 44 18 335 | 12/1994 |
| DE | 103 17 311 | 11/2004 |
| WO | 92/13473 | 8/1992 |
| WO | 01/50916 | 7/2001 |
| WO | 2011/094771 | 8/2011 |
| WO | 2017/000003 | 1/2017 |

OTHER PUBLICATIONS

Search Report dated Sep. 7, 2017 in Austrian Application No. 805/2015, with English translation.

* cited by examiner

DRAWER ARRANGEMENT

BACKGROUND OF THE INVENTION

The present invention relates to a drawer arrangement, including a drawer side wall connected or configured to be connected to a drawer rail of a drawer pull-out guide, wherein the drawer side wall has a support portion for supporting a drawer bottom, a drawer pull-out guide having a carcass rail to be fixed to a furniture carcass, a drawer rail connected or configured to be connected to the drawer side wall, and a central rail displaceable between the carcass rail and the drawer rail. The central rail has a side limb and a transverse limb connected therewith, and the side limb of the central rail, at least over a region, is arranged laterally besides the support portion for the drawer bottom.

The invention further concerns a drawer with an arrangement of the type to be described.

DE 103 17 311 A1 shows in FIG. 1 a drawer pull-out guide in the form of a full extension and a drawer side wall, and a vertical main limb of the central rail is arranged laterally besides a support limb for a drawer bottom. In order for the lateral stability of the drawer pull-out guide to be increased, the central rail—as shown in FIG. 7—can have an asymmetric extended transverse limb protruding from the main limb at a right angle. Although this measure enables an improvement of the lateral stability for the drawer pull-out guide, there is still a considerable lateral tilting moment acting on the drawer pull-out guide when the drawer bottom is heavily loaded. A further disadvantage is the fact that a relative large installation space has to be provided for this construction.

It is an object of the present invention to propose a drawer arrangement of the type mentioned in the introductory part, having a more compact construction and a higher stability.

SUMMARY OF THE INVENTION

According to the invention, the transverse limb of the central rail, in the mounted position, protrudes at least partially below the support portion for the drawer bottom.

By virtue of the transverse limb of the central rail being located at least partially below the support portion, the weight force of the drawer, in the mounting position, can be introduced into the central rail with a reduced lateral operating distance. Thus, particularly when the drawer is heavily loaded, a reduced tilting moment is exerted on the drawer pull-out guide. A force introduction caused by the weight of the drawer thereby results closer to an imaginary vertical direction and in a very close position in relation to the furniture carcass, so that the vertical stiffness of the drawer pull-out guide is improved. In this way, rolling bodies of running carriages arranged between the carcass rail and the central rail and/or between the central rail and the drawer rail are loaded more evenly in a vertical direction and are thus subjected to reduced uneven strain (which can lead to undesired deformations).

A further advantage of the invention lies in the fact that the drawer bottom can be brought closer to the drawer pull-out guide, so that a wider drawer bottom with an enlarged surface for stored objects can be utilized.

For the improved absorption of vertical forces, the side limb of the central rail can have a greater length than the transverse limb. The ratio of the height of the side limb relative to the width of the transverse limb can thereby lie between 1:0.4 and 1:1, and more preferably between 1:0.5 and 1:0.7.

The side limb, together with the transverse limb, can have a one-piece configuration, for example in such a way that the side limb and the transverse limb jointly form an L-shape having two limbs extending substantially at a right angle relative to one another.

In order to increase the torsional stiffness, the side limb can have at least one reinforcement groove extending in a longitudinal direction of the central rail at least over a region. The reinforcement groove, in the mounted position, is arranged approximately at an intermediate height of the side limb.

For the additional improvement of the tilting safety of the drawer pull-out guide, the transverse limb can have a free end region which is configured to be supported by at least one rolling body on the carcass rail. This rolling body can thereby be arranged in a running carriage configured to run, at least over a region, along the transverse limb in a longitudinal direction of the central rail.

The drawer according to the invention is characterized by an arrangement of the described type.

BRIEF DESCRIPTION OF THE DRAWINGS

Further details and advantages of the present invention will be explained with the aid of the following description of figures, in which.

DETAILED DESCRIPTION OF THE INVENTION

Figure 1:
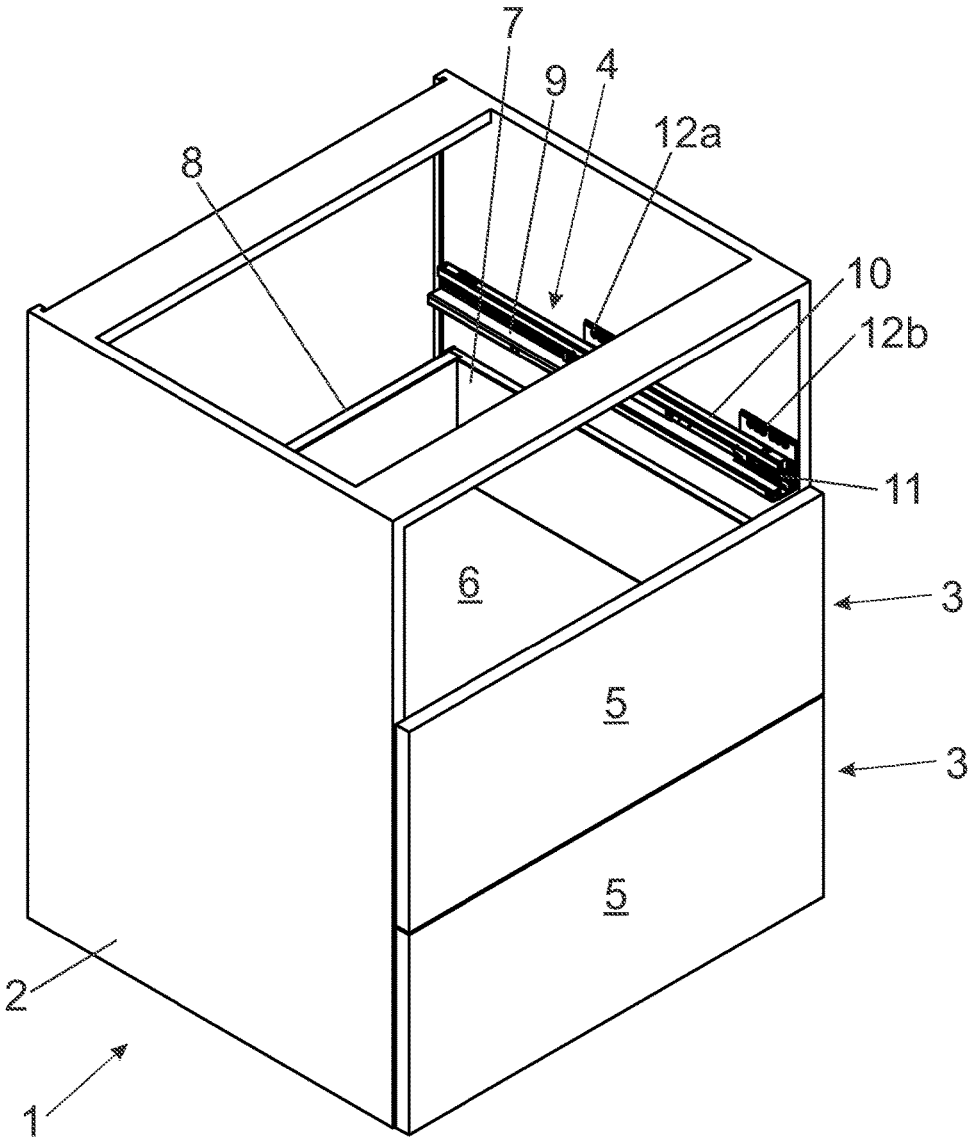
FIG. 1 shows a perspective view of an item of furniture having a furniture carcass and drawers displaceable relative thereto.

FIG. 1 shows an item of furniture 1 with a cupboard-shaped furniture carcass 2, wherein drawers 3 are displaceably supported relative to the furniture carcass 2 by drawer pull-out guides 4. The drawers 3 each have a front panel 5, a drawer bottom 6, drawer side walls 7 and a rear wall 8. The drawer pull-out guides 4 each include a carcass rail 9 configured to be fixed to the furniture carcass 2 by fastening portions 12*a*, 12*b*, a drawer rail 10 which is displaceable relative to the carcass rail 9 and which is connected or which can be connected to the drawer side wall 7, and a central rail 11 displaceable between the carcass rail 9 and the drawer rail 10 so as to allow the drawer 3 to be fully extended.

Figure 2:
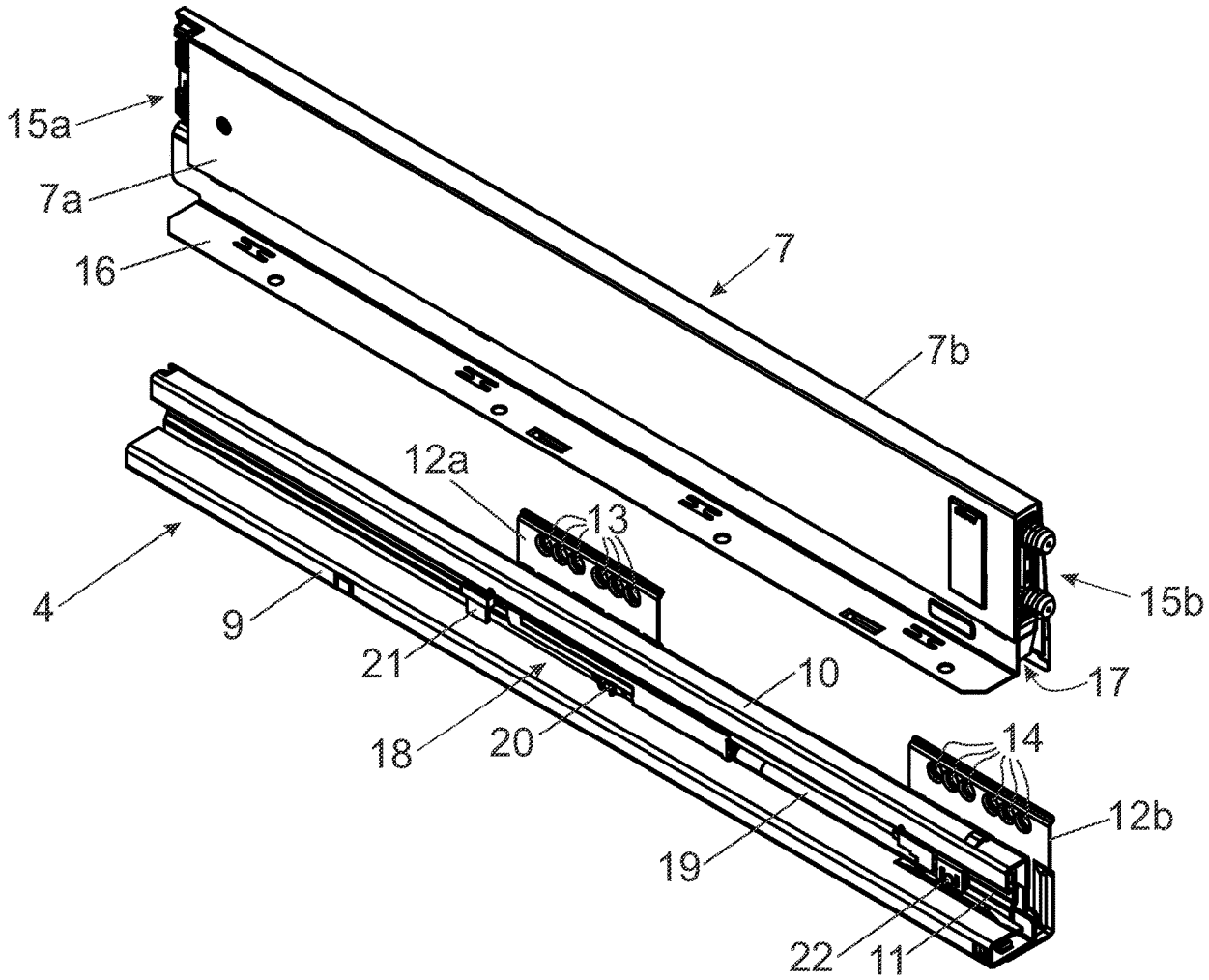
FIG. 2 shows a drawer pull-out guide with a drawer rail to be connected to a drawer side wall.

FIG. 2 shows an arrangement with a drawer pull-out guide 4 and with a drawer side wall 7 in a perspective view. The fastening portions 12*a*, 12*b* connected to the carcass rail 9 include one or a plurality of fastening locations 13, 14 for the attachment to the furniture carcass 2. A displaceable central rail 11 is arranged between the drawer rail 10 and the carcass rail 9, wherein arranged on the drawer rail 10 is a coupling element 21 configured to be releasably coupled to an entrainment member 20 of a retraction device 18, so that the drawer rail 10, at the end of the closing movement, is engaged by the entrainment member 20 and can be retracted into the closed end position by an energy storage member of the retraction device 18. By a damping device 19, preferably with a hydraulic piston-cylinder-unit, the spring-assisted retraction movement of the drawer rail 10 can be decelerated towards the closed end position. In the front end region of the drawer rail 10, at least one supporting roller 22 is mounted for supporting the drawer rail 10 in the closed end position relative to the carcass rail 9, so that sagging of the front panel 5 relative to the furniture carcass 2 is prevented.

The drawer side wall 7 is configured as a hollow-chamber profile with an inner profiled wall 7*a* and an outer profiled wall 7*b*, and the drawer side wall 7 forms a channel 17 for accommodating the drawer rail 10. The channel 17 is configured to be open from below and extends in the longitudinal direction of the drawer side wall 7. The drawer side wall 7 further includes a first fastening device 15*a* for connecting the rear wall 8, a second fastening device 15*b* for connecting the front panel 5, and a support portion 16 for supporting the drawer bottom 6. For example, the support portion 16 can be formed by a limb of the drawer side wall 7, wherein the limb is bent in an L-shaped manner.

Figure 3:
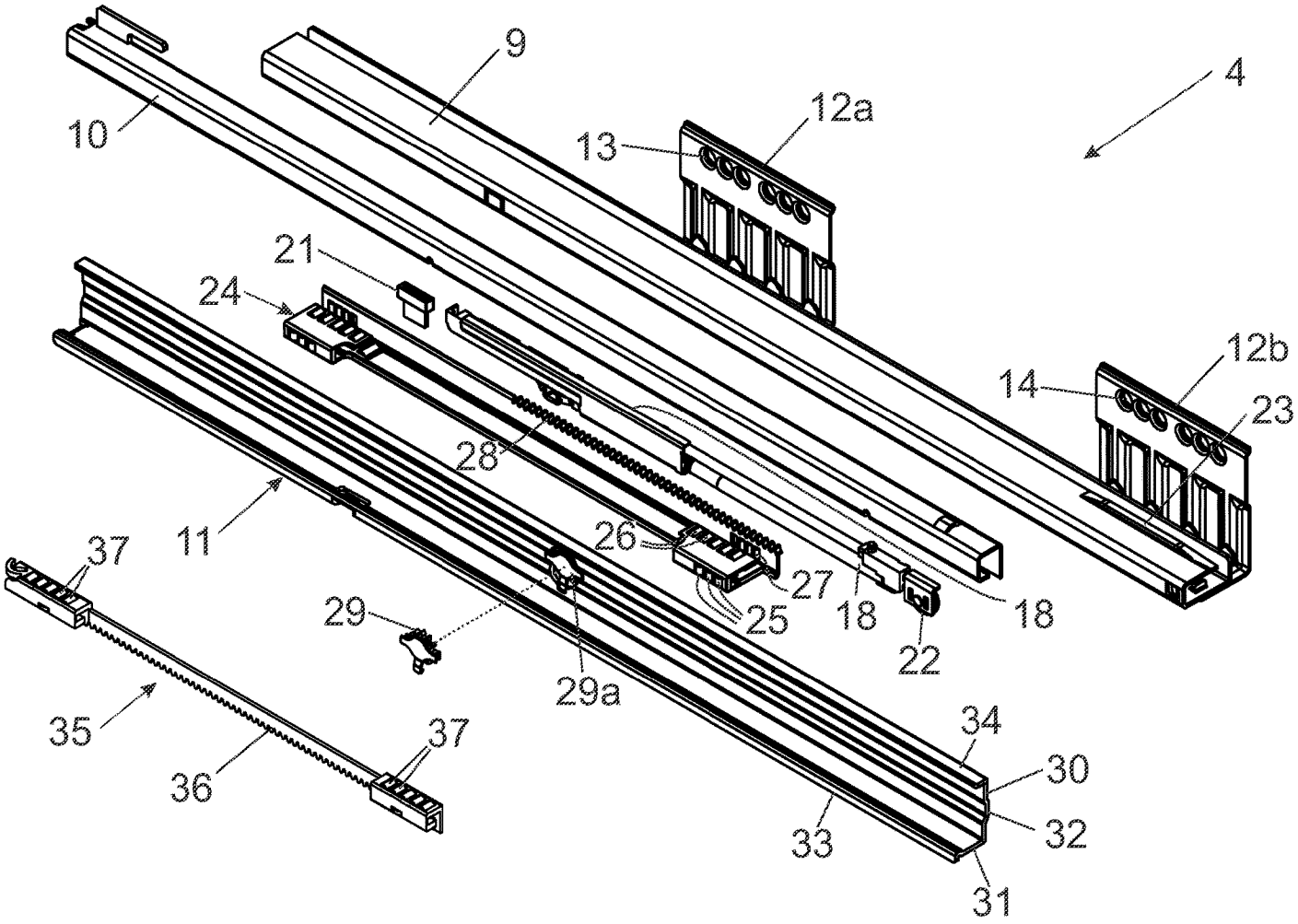
FIG. 3 shows the drawer pull-out guide in an exploded view.

FIG. 3 shows the drawer pull-out guide 4 in an exploded view. On the front end of the carcass rail 9, an elevation 23 is formed which cooperates, in the closed end position of the drawer rail 10, with the supporting roller 22 arranged on the drawer rail 10 and thus holds the front panel 5 in a predetermined height position when the drawer 3 is closed. A gear 29 is arranged in a recess 29*a* of the central rail 11 in order for a relative movement between the central rail 11 and the drawer rail 10 to be synchronized, and the gear 29 cooperates with a tooth arrangement 36 of a first running carriage 35. The first running carriage 35 is displaceably arranged between the central rail 11 and the drawer rail 10 and includes rolling bodies 37 configured to run along a running limb 34 of the central rail 11, and the running limb 34 protrudes transversely from a side limb 30 of the central rail 11, preferably substantially at a right angle. Moreover, a second running carriage 24 is provided which is displaceable between the carcass rail 9 and the central rail 11. The second running carriage 24 also has a tooth arrangement 28 cooperating with the gear 29 of the central rail 11. The second running carriage 24 has two groups of rolling bodies spaced from each other in a longitudinal direction, the groups of rolling bodies have rolling bodies 25, 26, 27. The rolling bodies 25 and 27, in the mounted position, each have a vertically extending pivoting axis, and the rolling bodies 26 each have a horizontally extending pivoting axis. A transverse limb 31 is connected to the side limb 30 of the central rail 11, and the transverse limb 31 protrudes from the side limb 30, preferably substantially at a right angle. The side limb 30 of the central rail 11 is provided with at least one reinforcing groove 32 extending in the longitudinal direction of the central rail 11, and the reinforcing groove 32 is located substantially at an intermediate height of the side limb 30. The transverse limb 31 has a free end region with a bent edge 33 extending in a longitudinal direction of the central rail 11, and the edge 33 can be supported by the rolling bodies 25, 26, 27 of the second running carriage 24 relative to the carcass rail 9. By virtue of this support, the lateral stability of the drawer pull-out guide 4 can be considerably improved, even in the case of heavy loads.

Figure 4:
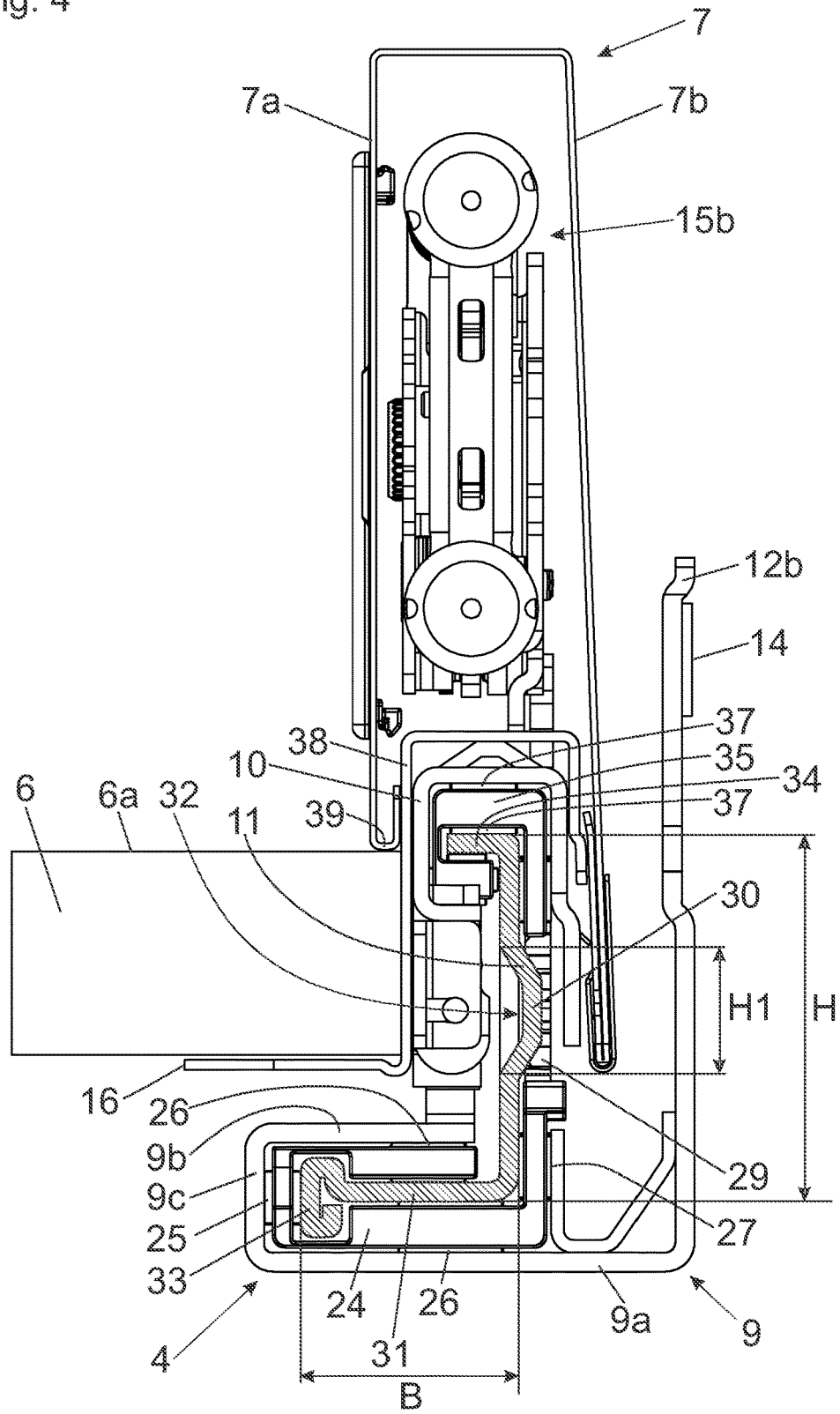
FIG. 4 shows a cross-section of the drawer pull-out guide and the drawer side wall connected thereto.

FIG. 4 shows a cross section of the drawer pull-out guide 4 with the carcass rail 9, the central rail 11, the drawer rail 10, and the drawer side wall 7 connected to the drawer rail 10. The drawer bottom 6 is supported on the support portion 16 of the drawer side wall 7. For the sake of improved visualization, the central rail 11 is displayed in a hatched pattern. The carcass rail 9 has two limbs 9*a*, 9*b* spaced from each other in the height direction in a parallel relationship, the limbs 9*a*, 9*b* are connected to each other by a limb 9*c*. The central rail 11 has a, preferably vertically extending, side limb 30 and a transverse limb 31 protruding transversely therefrom, preferably substantially at a right angle. The side limb 30 of the central rail 11 is arranged, at least over a region, laterally besides the support portion 16 for the drawer bottom 6. The transverse limb 31 of the central rail 11, on the contrary, protrudes at least partially below the support portion 16 for the drawer bottom 6 and thereby reduces the tilting moment acting on the drawer pull-out guide 4, the tilting moment is increased by stored items positioned on the surface 6*a* of the drawer bottom 6. The height (H) of the side limb 30 is configured so as to be longer than the width (B) of the transverse limb 31, wherein the width (B) of the transverse limb 31 has at least half of the length of the height (H) of the side limb 30. In the shown figure, the first running limb 34 is located substantially at the same height or above the surface 6*a* of the drawer bottom 6, and the drawer bottom 6 lies between the running limb 34 and the transverse limb 31 of the central rail 11. The ratio of the height (H) of the side limb 30 relative to the width (B) of the transverse limb 31 can be between 1:0.4 and 1:1, and preferably between 1:0.5 and 1:0.7. Arranged on the free end region of the transverse limb 31 is a bent edge 33 extending in the longitudinal direction (L), the bent edge 33, in the shown figure, is preferably configured as a folding or a multiple-bent. The bent edge 33, in the shown figure, is configured so as to have a T-shape in cross-section and can be supported relative to the carcass rail 9 by at least one rolling body 25, preferably by the second running carriage 24 having a plurality of rolling bodies 25, 26, 27 (FIG. 3), and the second running carriage 24 is configured to run along the transverse limb 31. The T-shaped end region of the bent edge 33 forms, on the one hand, a vertically extending supporting surface for the rolling body 25 or the rolling bodies 25 and provides, on the other hand, an optimal guidance for the second running carriage 24 in the longitudinal direction (L) of the transverse limb 31. A first running carriage 35 is displaceably arranged between the central rail 11 and the drawer rail 10, and the rolling bodies 37 of the first running carriage 35 cooperate, on the one hand, with the running limb 34 of the central rail 11 and, on the other hand, with a running surface of the drawer rail 10. The gear 29 pivotally arranged on the side limb 30 cooperates, on the one hand, with the first running carriage 35 and, on the other hand, with the second running carriage 24 and synchronizes a movement of the running carriages 24, 35 and a movement of the central rail 11 and the drawer rail 10 relative to one another. The side limb 30 is provided with at least one reinforcing groove 32 extending at least over a region in a longitudinal direction of the central rail 11. The reinforcing groove 32, in the mounted position, is arranged substantially at an intermediate height (H) of the side limb 30. The ratio of the height (H) of the side limb 30 relative to the height (H1) of the reinforcing groove 32 can be between 1:0.2 and 1:0.5. Formed on the drawer side wall 7 is an abutment surface 39, so that the drawer bottom 6 is secured against lifting between the support portion 16 und the abutment surface 39.

The support portion 16, in the shown embodiment, is arranged on an elongated carrier rail 38 in the form of an L-shaped limb, wherein the support rail 38 is connected to the drawer side wall 7. Thereby, it can be provided that the carrier rail 38 is welded to the inner profiled wall 7*a* and to the outer profiled wall 7*b* of the drawer side wall 7.

Alternatively, it is also possible that the drawer side wall 7 can be releasably locked to the drawer rail 10 by a locking device.

Figure 5:
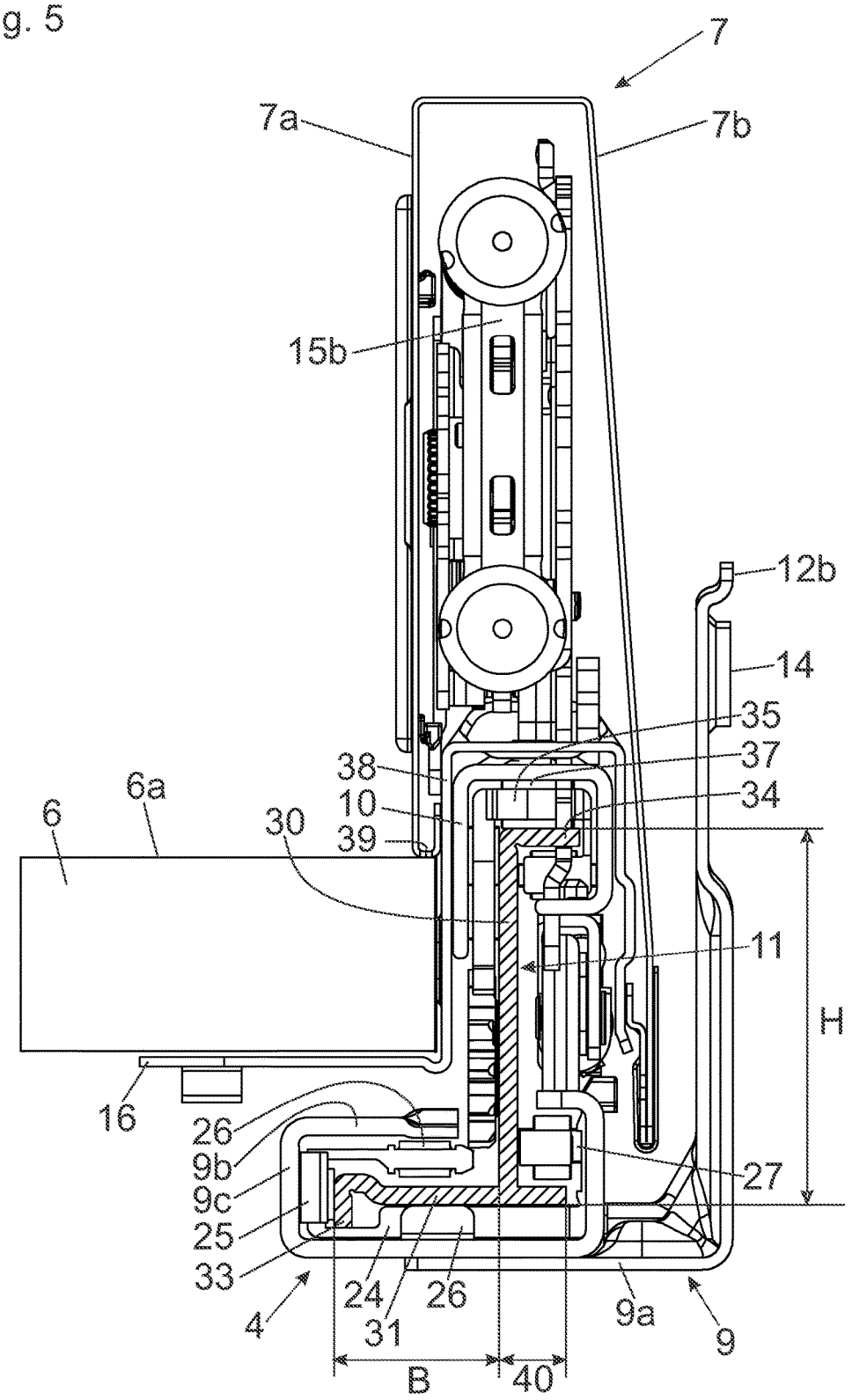
FIG. 5 shows a cross-section of the drawer pull-out guide with an alternative form of the central rail.

FIG. 5 shows the drawer pull-out guide 4 with the central rail 11 in an alternative embodiment, and the central rail 11 is displayed in a hatched pattern for the sake of improved visualization. The central rail 11 has a side limb 30 having a height (H), the side limb 30 is arranged laterally besides the support portion 16 for the drawer bottom 6. The transverse limb 31 having the width (B) protrudes at least partially below the support portion 16 for the drawer bottom 6. Moreover, the central rail 11 includes a further transverse limb 40 protruding transversely from the side limb 30 in a direction towards the fastening portion 12*a* of the carcass rail 9.

The second running carriage 24 with the rolling bodies 26 protrudes below the second transverse limb 40, so that an enlarged overall supporting surface for the central rail 11 is made available.

Figure 6:
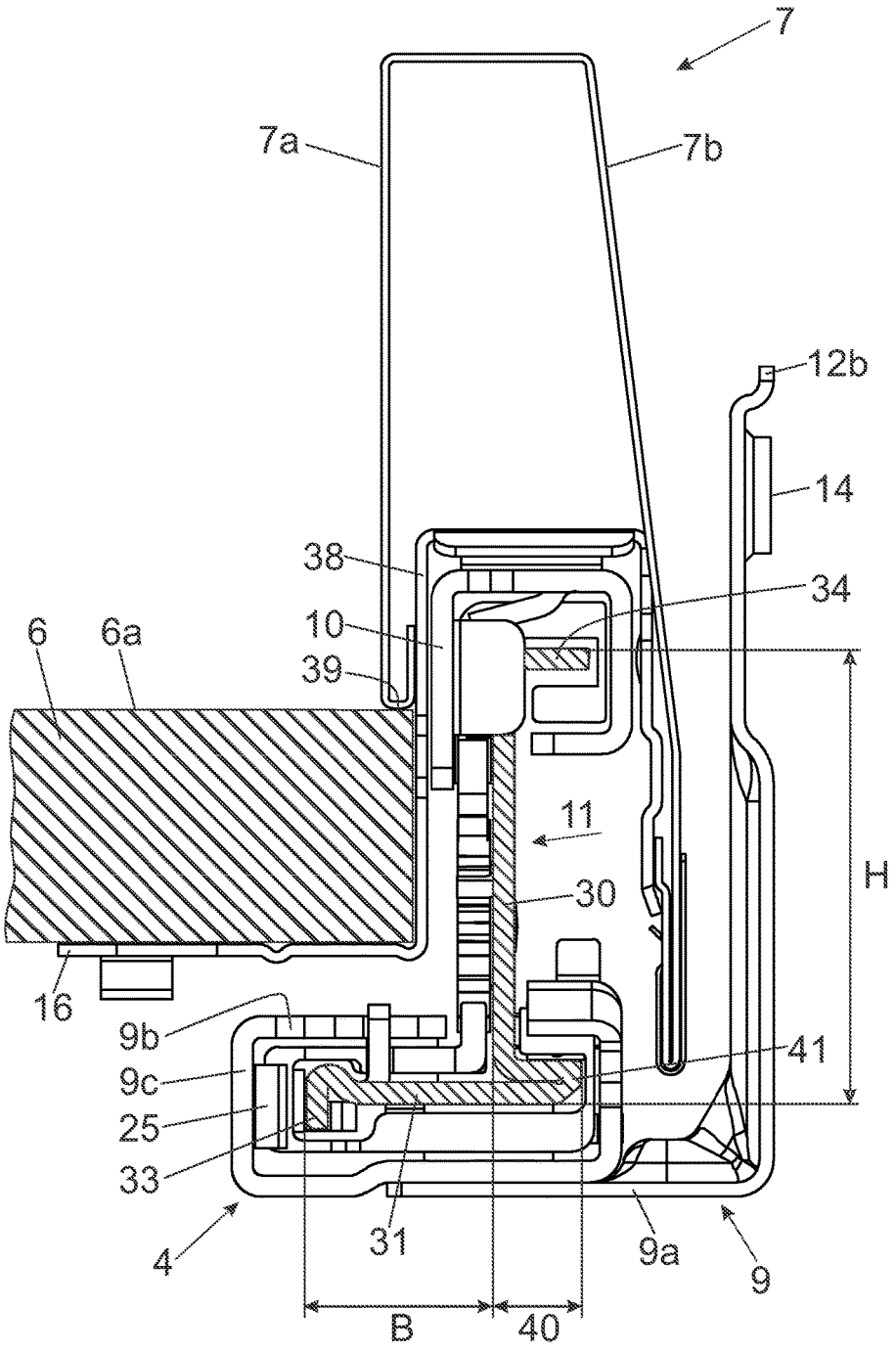
FIG. 6 shows a cross-section of the drawer pull-out guide with the central rail in a further embodiment.

FIG. 6 shows a cross-section of the drawer pull-out guide 4 with a central rail 11 slightly modified in comparison to FIG. 4. In this figure, the transverse limb 40 is connected to the side limb 30 of the central rail 11 by a foldover 41 (also known as a doubling or rabbet) such that the central rail 11 can be easily manufactured by a bending process. By the foldover 41, which preferably extends over the entire length of the central rail 11, an improved stiffness can be provided about an axis extending in a longitudinal direction of the drawer pull-out guide 4, so that the rolling bodies of the drawer pull-out guide 4 are loaded to a less extent and more uniformly. This construction, in particular, is also suitable for high loading classes.

The invention claimed is:

1. A drawer arrangement, comprising:

a drawer side wall, the drawer side wall having a support portion for supporting a drawer bottom; and a drawer pull-out guide having a carcass rail to be fixed to a furniture carcass, a drawer rail connected to the drawer side wall, and a central rail displaceable between the carcass rail and the drawer rail, the central rail having a side limb and a transverse limb connected therewith;

wherein at least a portion of the side limb of the central rail is arranged laterally besides the support portion, wherein the transverse limb of the central rail and the carcass rail protrude at least partially below the support portion, and wherein the transverse limb of the central rail has a free end region supported on the carcass rail by at least one rolling body.

2. The drawer arrangement according to claim 1, wherein a ratio of a height of the side limb relative to a width of the transverse limb is between 1:0.4 and 1:1.

3. The drawer arrangement according to claim 2, wherein the ratio is between 1:0.5 and 1:0.7.

4. The drawer arrangement according to claim 1, wherein the side limb and the transverse limb have a one-piece configuration.

5. The drawer arrangement according to claim 1, wherein the central rail has a first running limb protruding from the side limb of the central rail, the drawer arrangement further comprising a first running carriage configured to run along the first running limb.

6. The drawer arrangement according to claim 5, wherein the first running carriage has rolling bodies cooperating with both the first running limb of the side limb and with a running surface of the drawer rail.

7. The drawer arrangement according to claim 1, wherein the free end region of the transverse limb has a bent edge supported relative to the carcass rail by the at least one rolling body.

8. The drawer arrangement according to claim 1, wherein the at least one rolling body is arranged in a second running carriage configured to run along the transverse limb.

9. The drawer arrangement according to claim 1, wherein the support portion for supporting the drawer bottom is an L-shaped limb of the drawer side wall.

10. A drawer comprising a drawer arrangement according to claim 1, wherein the drawer further comprises a drawer bottom supported on the support portion of the drawer side wall.

11. A drawer arrangement comprising:

a drawer side wall, the drawer side wall having a support portion for supporting a drawer bottom; and a drawer pull-out guide having a carcass rail to be fixed to a furniture carcass, a drawer rail connected to the drawer side wall, and a central rail displaceable between the carcass rail and the drawer rail, the central rail having a side limb and a transverse limb connected therewith;

wherein at least a portion of the side limb of the central rail is arranged laterally besides the support portion, wherein the transverse limb of the central rail and the carcass rail protrude at least partially below the support portion, wherein the central rail has a first running limb protruding from the side limb of the central rail, the drawer arrangement further comprising a first running carriage configured to run along the first running limb, and wherein the first running limb of the central rail is arranged above the support portion.

12. A drawer having a drawer arrangement according to claim 11, wherein the first running limb protrudes at a right angle from the side limb of the central rail.

13. A drawer arrangement comprising:

a drawer side wall, the drawer side wall having a support portion for supporting a drawer bottom; and a drawer pull-out guide having a carcass rail to be fixed to a furniture carcass, a drawer rail connected to the drawer side wall, and a central rail displaceable between the carcass rail and the drawer rail, the central rail having a side limb and a transverse limb connected therewith;

wherein at least a portion of the side limb of the central rail is arranged laterally besides the support portion, wherein the transverse limb of the central rail and the carcass rail protrude at least partially below the support portion, wherein the central rail has a first running limb protruding from the side limb of the central rail, the drawer arrangement further comprising a first running carriage configured to run along the first running limb, and wherein the drawer bottom to be arranged on the support portion has a surface provided for storing items, and the first running limb is located at a height equal to or above the surface of the drawer bottom.

14. A drawer having a drawer arrangement according to claim 13, wherein the first running limb protrudes at a right angle from the side limb of the central rail.

15. A drawer arrangement comprising:

a drawer side wall, the drawer side wall having a support portion for supporting a drawer bottom; and a drawer pull-out guide having a carcass rail to be fixed to a furniture carcass, a drawer rail connected to the drawer side wall, and a central rail displaceable between the carcass rail and the drawer rail, the central rail having a side limb and a transverse limb connected therewith;

wherein at least a portion of the side limb of the central rail is arranged laterally besides the support portion, wherein the transverse limb of the central rail and the carcass rail protrude at least partially below the support portion, wherein the side limb has at least one reinforcing groove at least partially extending in a longitudinal direction of the central rail.

16. The drawer arrangement according to claim 15, wherein the at least one reinforcing groove is arranged at an intermediate height of the side limb.

17. The drawer arrangement according to claim 16, wherein a ratio of a height of the side limb relative to a height of the at least one reinforcing groove is between 1:0.2 and 1:0.5.

* * * * *